United States Patent [19]

Poole et al.

[11] 4,211,390

[45] Jul. 8, 1980

[54] APPARATUS FOR SHIELDING MOLTEN METAL DURING TEEMING

[75] Inventors: Brian Poole, South Leverton; Philip J. Young, Tuxford, both of England

[73] Assignee: Air Products and Chemicals, Inc., Allentown, Pa.

[21] Appl. No.: 36,487

[22] Filed: May 7, 1979

[51] Int. Cl.[2] ..... B22D 11/10; B22D 23/00; C22B 9/00

[52] U.S. Cl. ..... 266/207; 164/259; 164/415; 266/217

[58] Field of Search ..... 164/259, 415, 66; 266/207, 217

[56] References Cited

U.S. PATENT DOCUMENTS

| | | | |
|---|---|---|---|
| 2,905,989 | 9/1959 | Black | 164/415 X |
| 3,482,621 | 12/1969 | Halliday | 164/415 X |
| 3,616,843 | 11/1971 | Newhall et al. | 164/259 X |
| 3,756,305 | 9/1973 | Haussner | 164/415 X |
| 3,841,385 | 10/1974 | Burk | 164/259 X |
| 4,090,552 | 5/1978 | Laird et al. | 164/415 X |

FOREIGN PATENT DOCUMENTS

| | | | |
|---|---|---|---|
| 768317 | 12/1971 | Belgium | 164/415 |

*Primary Examiner*—Robert D. Baldwin
*Assistant Examiner*—J. Reed Batten, Jr.
*Attorney, Agent, or Firm*—James C. Simmons; E. Eugene Innis

[57] ABSTRACT

An apparatus for shielding a stream of molten metal during teeming consisting of a pair of cylinders aligned on a common axis by means adapted to position one cylinder against a ladle around the pouring spout and the second cylinder proximate a tundish, ingot mold or pouring trumpet. Also included are means to form a gas barrier between the cylinders to contain a shielding (inert) gas around the molten metal stream to protect the stream from contact by the ambient atmosphere and means to mount the apparatus on a pouring ladle carriage.

7 Claims, 3 Drawing Figures

APPARATUS FOR SHIELDING MOLTEN METAL DURING TEEMING

BACKGROUND OF THE INVENTION

1. Field of the Invention

This invention relates to an apparatus for shielding molten metal during teeming and to a carriage provided with such apparatus.

2. Description of the Prior Art

The desirability and one apparatus for shielding molten metal during a teeming operation are described in U.S. Pat. No. 4,023,614.

To accomplish shielding or teem stream protection as it is sometimes called requires excursion of the ambient atmosphere (usually air) from contact with the molten metal stream. This is usually accomplished by surrounding the stream with a gas that will not react with the molten metal to form harmful reaction products that become trapped in the solidified metal. Such inert (to the metal) gases include argon and helium among others. To confine the gas prior art workers have designed devices to, in effect, form a continuous wall around and spaced apart from the molten stream with means to introduce the inert gas into the space between the wall stream.

Examples of such prior art devices are shown in U.K. Pat. Nos. 1,363,111; 1,086,094, 1,371,880, 1,480,944, 1,468,528, 1,525,039, 1,372,801, 1,221,545, 1,079,560, 781,276 and 781,277.

SUMMARY OF THE INVENTION

According to the present invention there is provided an apparatus for shielding a stream of molten metal during teeming, which apparatus comprises a first arm pivotably mountable on a carriage capable of carrying a ladle; a second arm pivotably mountable on said carriage; a first cylinder open at both ends, connected to said first arm, and having one end which, during teeming, is urged against the pouring spout on the bottom of a ladle mounted on said carriage; a second cylinder open at both ends, connected to said second arm, and moveable relative to said first cylinder to vary the distance between said first and second cylinders, and means to introduce a shielding gas into the interior of said cylinders, the arrangement being such that, in use, after the pouring spout of a ladle is arranged over an ingot mold, tundish or pouring trumpet, said arms can be moved so that said first and second cylinders define a passageway between the pouring spout on the ladle and the ingot mold, tundish or pouring trumpet into which shielding gas can be introduced via said means to inhibit air coming into contact with molten metal as it passes through said passageway.

Preferably, means are provided to bias said first cylinder, in use, against the pouring nozzle on said ladle. Such means may conveniently comprise a counterweight mounted on said first arm.

Advantageously, said second cylinder is connected to said first cylinder by a flexible support. Such a support may conveniently be defined by chain linking which is preferably of relatively small mesh, e.g. 0.25 inches (6.35 mm), and is arranged to prevent molten metal splashes from interjecting with said cylinder movement.

Conveniently, a seal, for example an asbestos sleeve, can be mounted on the outside of said first and second cylinders to inhibit loss of shielding gas therebetween. In this connection, for the avoidance of doubt, the term cylinder, as used herein, embraces bodies of all cross-sections, e.g. rectangular, square and polygonal, although bodies of circular cross-section are preferred.

In order to inhibit splashes of molten metal reducing the flow of shielding gas into the inside of the cylinders, the end of the first cylinder, remote from the second cylinder, may conveniently be provided with an inwardly extending lip which, with the inner surface of said first cylinder, defines a cavity opening towards said second cylinder, and means are provided for introducing shielding gas into said cavity.

The present invention also embraces an apparatus used for bottom pouring ingots including a carriage provided with apparatus in accordance with the present invention. In such an embodiment, in order to inhibit damage to the pouring trumpets, means are preferably provided so that the carriage is rendered immobile when one or both the first and second cylinders are in such a position that movement of the carriage could result in the cylinder(s) damaging the pouring trumpet(s).

Therefore, it is the primary object of the present invention to provide an apparatus which, in conjunction with a shielding gas, will inhibit air entering the molten metal during teeming.

DETAILED DESCRIPTION OF THE PREFERRED EMBODIMENTS

Figure 1:
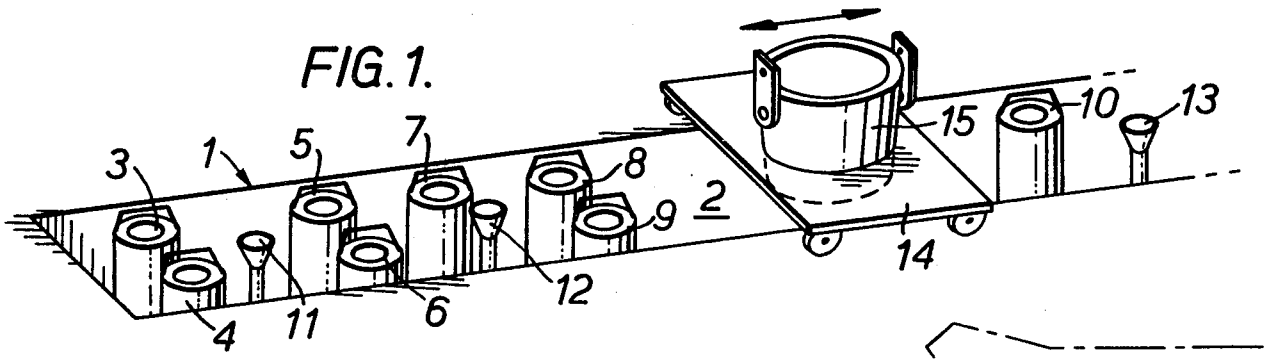
FIG. 1 is a schematic perspective view of an installation for teeming molten metal into ingots suitable for utilization of the apparatus of the present invention.

FIG. 1 is a schematic perspective view of an installation for producing metal ingots by bottom pouring. The installation, which is generally identified by reference numeral 1, comprises a pit 2, which is typically 80 feet long, 12 feet wide and 12 feet deep. A plurality of ingot molds 3 to 10 are disposed in the pit 2 adjacent a plurality of pouring trumpets 11, 12 and 13. A carriage 14 carrying a ladle 15 is arranged to move along the pit 2. The bottom of the ladle 15 is provided with a pouring spout (not shown). In use, ladle 15 is filled with molten metal and is lowered into position on carriage 14 by a crane. Carriage 14 is then moved along the pit until the pouring spout is directly above one of the pouring trumpets. A plug is then withdrawn upwardly from the pouring spout and molten metal passes downwardly through the pouring trumpet and up inside the ingot molds associated with the pouring trumpet. The operation of pouring molten metal through the bottom of a ladle is known as teeming.

Typically, there is a gap of 10 to 12 inches between the bottom of the pouring spout on the ladle 15 and the top of the pouring trumpet. During teeming air comes into contact with the molten metal entering the trumpet and causes undesirable oxidation to occur.

It has been proposed to reduce oxidation by two methods. In one method, the carriage 14 is dispensed with and the ladle 15 is lowered onto the pouring trumpet and held in position during teeming by an overhead crane. This prevents the crane being used for other work during teeming. In another method, a curtain of argon is formed around the molten metal stream by directing jets of argon downwardly from a torroidal nozzle supported around the pouring spout. Although effective, this method consumes a substantial quantity of argon.

Figure 2:
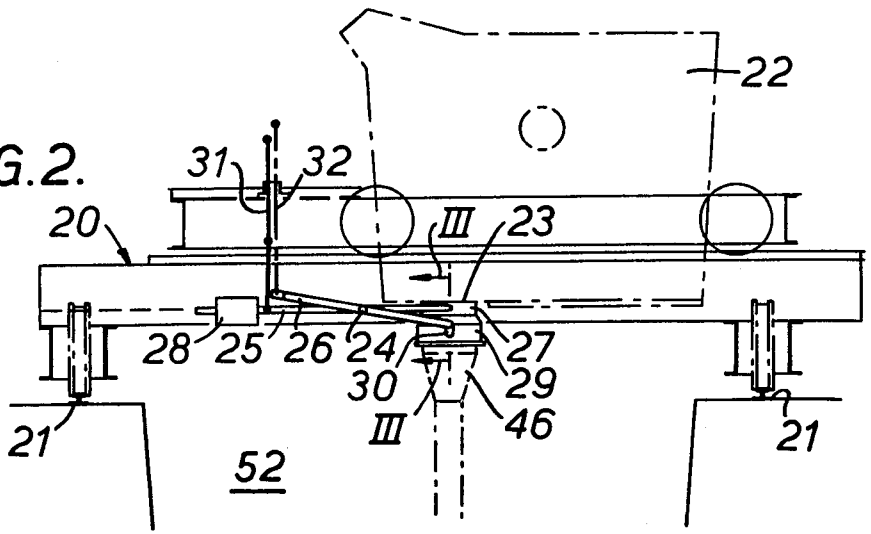
FIG. 2 is an end elevation of a carriage provided with apparatus in accordance with the present invention positioned for teeming.
Figure 3:
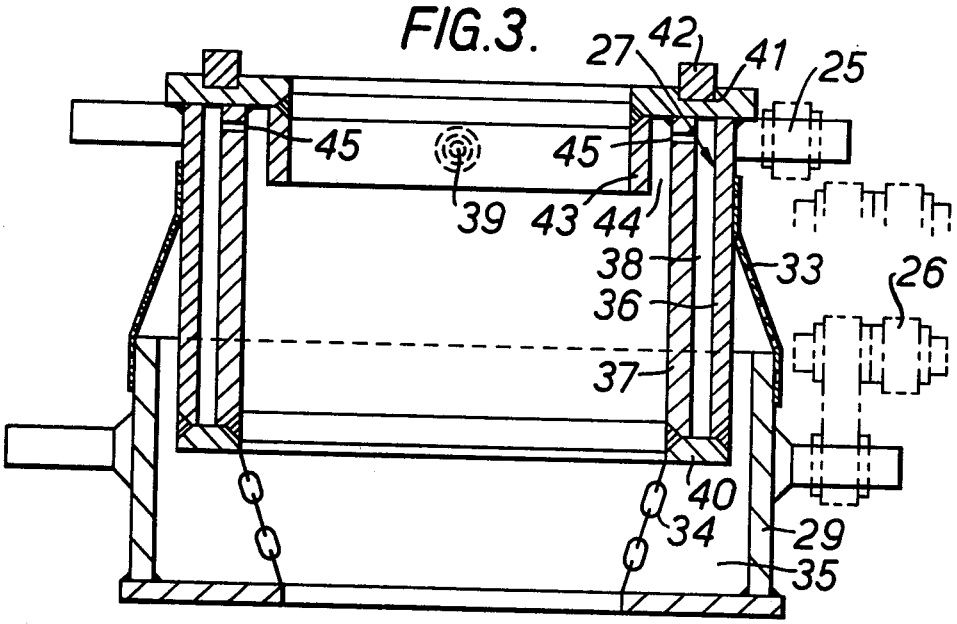
FIG. 3 is a section taken along line III—III of FIG. 2.

Referring to FIGS. 2 and 3, there is shown a carriage 20, which is mounted on rails 21, disposed to either side of a casting pit 52. The carriage 20 is provided with trunions (not shown) which support a ladle 22 having a pouring spout 23.

A horizontal shaft 24 is mounted fast on the carriage 20 and acts as a pivot for a first bifurcated arm 25 and a second bifucated arm 26. A first cylinder 27 is mounted between the bifucated ends of the first arm 25 and is biased against the pouring spout 23 on the ladle 22 by counterweight 28. A second cylinder 29 is mounted between the bifucated ends of the second arm 26 by means of pivotably mounted links, one of which is identified by reference numeral 30.

First arm 25 is provided with a first control arm 31 and second arm 26 is provided with a second control arm 32. As shown in FIG. 3, an asbestos seal 33 is disposed around the outer surfaces of the first and second cylinders 27 and 29 respectively and inhibits argon escaping from inside the cylinders whilst permitting limited axial movement between said cylinders.

In order to limit movement between the first and second cylinders 27 and 29, a chain link shield 34 is secured to the bottom of the first cylinder 27 and the bottom of the second cylinder 29. As will be seen from FIG. 3, the chain link shield 34 is funnel shaped and, in use, inhibits molten metal entering the space generally identified by reference numeral 35.

The first cylinder 27 comprises a pair of walls 36 and 37 which define an annular chamber 38 which communicates with an argon feed pipe 39. The anular chamber 38 is sealed by a bottom flange 40 and an upper flange 41 which supports an asbestos sealing ring 42 and includes a lip 43 which defines, with the wall 37, a cavity 44. Forty 0.25 inches (6.35 mm) diameter holes 45 are bored through the wall 37 where shown and allow argon to flow from argon feed pipe 39 to the inside of the first and second cylinders 27 and 29.

In use, carriage 20 is moved along rails 21 until the pouring spout 23 on ladle 22 is directly above pouring trumpet 46. During this time counterweight 28 biases the seal 42 on first cylinder 27 against the bottom of the laddle 22 circumjacent the pouring spout 23 and second cylinder 29 is held in a raised position by second control arm 32.

Once in position the operator raises control arm 32. This immediately actuates a switch immobilizing carriage 20. The second cylinder 29 moves downwardly until it rests on the top of the pouring trumpet 46.

Once in position argon is introduced through argon feed pipe 39 and flows through pouring trumpet 46 and out of the ingot molds thereby removing a substantial quantity of air from therein. Teeming is then commenced and the flow of argon is continued until teeming is complete. At the end of teeming the second cylinder 29 is raised to allow a sample of molten metal to be taken for analysis.

If the pouring spout 23 becomes blocked, first control arm 31 can be raised thereby lowering first cylinder 27 sufficient for the insertion of an oxygen lance.

Whilst argon is the preferred shielding gas it should be understood that other shielding gases may also be used, for example, in certain cases, nitrogen may be acceptable.

Whilst the present invention is particularly intended for use in casting ingots, it is also applicable to continuous casting wherein the molten metal is teemed into a tundish.

Having thus described our invention what is desired to be secured by Letters Patent of the United States is set forth in the appended claims.

What we claim is:

1. Apparatus for shielding molten metal during teeming which apparatus comprises a first arm pivotably mountable on a carriage for carrying a ladle, a second arm pivotably mountable on said carriage, a first cylinder open at both ends, connected to said first arm and having one end which, during teeming, is urged against the pouring spout on the bottom of a ladle mounted on said carriage, a second cylinder open at both ends, connected to said second arm, and moveable relative to said first cylinder to vary the distance between said first and second cylinders, and means to introduce a shielding gas into the interior of said cylinders, the arrangement being such that, in use, after the pouring spout of a ladle is arranged over a pouring trumpet, said arms can be moved so that said first and second cylinders define a passageway between the pouring spout on the ladle and the pouring trumpet into which shielding gas can be introduced via said means to inhibit air coming into contact with molten metal as it passes through said passageway.

2. An apparatus as claimed in claim 1, comprising means to bias said first cylinder, in use, against the pouring spout on said ladle.

3. An apparatus as claimed in claim 1 or 2, wherein said second cylinder is connected to said first cylinder by a flexible support.

4. An apparatus as claimed in claim 3, wherein said flexible support comprises chain linking which is arranged to prevent molten metal splashes from interfering with said cylinder movement.

5. An apparatus as claimed in claim 1 including a seal between said first and second cylinders to inhibit loss of shielding gas therebetween.

6. An apparatus as claimed in claim 1 wherein said first cylinder is provided with an inwardly extending lip which, with the inner surface of said first cylinder, defines a cavity opening towards said second cylinder, and means are provided for introducing shielding gas entering said cavity.

7. An apparatus as claimed in claim 1, wherein means are provided to render said carriage immobile when one or both the first and second cylinders are in such a position that movement of the carriage could result in at least one of the cylinders damaging the pouring trumpets.

* * * * *